US009346074B2

(12) United States Patent
Hogan et al.

(10) Patent No.: US 9,346,074 B2
(45) Date of Patent: May 24, 2016

(54) CONFORMAL COATING APPLICATOR AND METHOD

(75) Inventors: Patrick T. Hogan, San Marcos, CA (US); Jon Tedrow, San Marcos, CA (US)

(73) Assignee: NORDSON CORPORATION, Westlake, OH (US)

( * ) Notice: Subject to any disclaimer, the term of this patent is extended or adjusted under 35 U.S.C. 154(b) by 1048 days.

(21) Appl. No.: 12/880,588

(22) Filed: Sep. 13, 2010

(65) Prior Publication Data

US 2012/0061426 A1 Mar. 15, 2012

(51) Int. Cl.

| | |
|---|---|
| ***B05C 21/00*** | (2006.01) |
| ***B05C 5/02*** | (2006.01) |
| ***B05C 11/10*** | (2006.01) |
| *B05B 1/30* | (2006.01) |

(52) U.S. Cl.

CPC ..... *B05C 5/0225* (2013.01); *B05C 11/1028* (2013.01); *B05B 1/306* (2013.01)

(58) Field of Classification Search

CPC .... B05C 11/1028; B05C 5/0225; B05B 1/306
USPC ..... 222/287, 504, 559; 239/583
See application file for complete search history.

(56) References Cited

U.S. PATENT DOCUMENTS

| | | | | |
|---|---|---|---|---|
| 5,186,393 | A * | 2/1993 | Yie | 239/583 |
| 5,221,025 | A * | 6/1993 | Privas | 222/1 |
| 5,336,320 | A | 8/1994 | Hogan et al. | |
| 5,707,010 | A | 1/1998 | Manfre et al. | |

(Continued)

FOREIGN PATENT DOCUMENTS

| | | |
|---|---|---|
| DE | 10046326 A1 | 4/2002 |
| JP | 5623767 | 3/1981 |

(Continued)

OTHER PUBLICATIONS

European Patent Office, European Search Report in EP Application No. 11180390, Nov. 23, 2011.

(Continued)

*Primary Examiner* — Daniel R Shearer
(74) *Attorney, Agent, or Firm* — Baker & Hostetler LLP

(57) ABSTRACT

An applicator for dispensing a liquid conformal coating material onto a substrate. The applicator includes a body assembly with a liquid flow passage having a liquid inlet adapted to receive the coating material and a liquid outlet. A valve seat is positioned between the liquid flow passage and the liquid outlet. A valve stem is mounted in the body assembly for reciprocating movement between an open position and a closed position. The valve stem includes a first end and a second end. The first end of the valve stem engages the valve seat in the closed position to stop flow of the liquid coating material through the outlet and disengages from the valve seat in the open position to allow flow of the liquid coating material through the outlet. A valve actuating mechanism is operative to move the valve stem from the open position to the closed position and is further operative to move the valve stem from the closed position to the open position. A resilient dampening element is operatively coupled between part of the body assembly and the valve stem. The resilient dampening element provides a biasing force against the valve stem as the valve stem moves from the closed position to the open position to reduce rebounding movement of the valve stem toward the closed position.

10 Claims, 5 Drawing Sheets

(56) References Cited

U.S. PATENT DOCUMENTS

| | | | | |
|---|---|---|---|---|
| 5,747,102 | A * | 5/1998 | Smith et al. | 427/98.4 |
| 6,244,522 | B1 | 6/2001 | Reighard et al. | |
| 6,253,957 | B1 * | 7/2001 | Messerly | B05C 5/001 222/1 |
| 6,523,759 | B1 | 2/2003 | D'Arrigo | |
| 6,619,269 | B1 | 9/2003 | Stier et al. | |
| 6,745,993 | B2 | 6/2004 | Mueller | |
| 6,869,034 | B2 | 3/2005 | Glaser | |
| 7,740,225 | B1 | 6/2010 | Estelle | |
| 2001/0042506 | A1 | 11/2001 | Hogan et al. | |
| 2004/0035955 | A1 | 2/2004 | Glaser | |
| 2006/0163390 | A1 | 7/2006 | Ruehle et al. | |
| 2009/0101669 | A1 * | 4/2009 | Hassler, Jr. | B05C 5/001 222/1 |
| 2009/0140079 | A1 | 6/2009 | Bertini et al. | |
| 2010/0071669 | A1 | 3/2010 | Grandi et al. | |

FOREIGN PATENT DOCUMENTS

| | | | |
|---|---|---|---|
| JP | S63137184 | | 6/1988 |
| JP | 01152176 | | 10/1989 |
| JP | H02154873 | | 6/1990 |
| JP | H04264606 | | 9/1992 |
| JP | H0547653 | | 2/1993 |
| JP | H11586 | | 1/1999 |
| JP | 2002213635 | A | 7/2002 |
| JP | 2002282740 | A | 10/2002 |
| JP | 2003269640 | A | 9/2003 |
| JP | 2006183754 | A | 7/2006 |
| JP | 2006189140 | A | 7/2006 |
| JP | 2007532298 | A | 11/2007 |
| WO | 2004/051073 | A1 | 6/2004 |
| WO | 2005/100232 | A2 | 10/2005 |
| WO | WO2005100232 | A2 | 10/2005 |

OTHER PUBLICATIONS

Japanese Patent Office, Notification of Reasons for Rejection in JP Application No. 2011195643, Mar. 5, 2015.

Japanese Application No. 2011-195643: Decision of Grant dated Jan. 4, 2016, 3 pages.

* cited by examiner

CONFORMAL COATING APPLICATOR AND METHOD

TECHNICAL FIELD

The present invention generally relates to applicators for dispensing liquid materials and more particularly, to an applicator for applying conformal coatings to substrates, such as electrical components.

BACKGROUND

Conformal coating is the process of applying a dielectric material onto a substrate. Typically, the substrate is an electrical product, such as a printed circuit ("PC") board or a device mounted thereon. Conformal coating, also called film coating protects the electrical components on the PC board from moisture, fungus, dust, corrosion, abrasion and other environmental stresses. Common conformal coating materials include silicone, acrylic, polyurethane, epoxy, synthetic resins and various polymers. When applied to PC boards, an insulative resin film of uniform thickness is formed as a solvent evaporates or, as a solvent free material is cured. Current applications require the conformal coating to be applied onto selected areas of the PC board and over some or all of the components thereon in order to preserve electrical and/or heat conduction properties. Applicators are conventionally pneumatically or electrically actuated, for example. In the case of pneumatically actuated applicators, an actuation valve, such as a solenoid valve, is used to supply positively pressurized actuation air to a piston chamber in the applicator in order to move a valve stem in the applicator to an open position. While the valve of the applicator is open, the film of coating material will be dispensed onto the substrate.

Automated systems may have one or several conformal coating applicators mounted on a robotic system. Machine speeds have gradually become faster and, therefore, faster actuation valves are used to cycle the applicator on and off as the robotic system moves the applicator relative to the PC board to selectively apply conformal coating to components on the board. The valve stem of the actuator reciprocates between a closed position in which a first end is engaged against valve seat, and an open position in which a second end is engaged against a hard stop element. Typically, the stop element is part of a stroke adjuster that allows the valve stem travel distance, or stroke, between the open and closed positions to be changed according to the application needs. With faster actuation valves, it has become more common to experience a "rebounding" effect as the valve stem impacts against the stop element at the end of the opening stroke. That is, the top end or second end of the valve stem will impact against the hard stop element, such as a stroke adjustment screw, and rebound or move slightly in the opposite direction one or more times before coming to a complete stop against the stop element. This rebounding movement will cause disruptions in the flow pattern at the leading end of the pattern (e.g., film) being applied to the substrate. For example, this phenomenon can cause the leading end of the film coating strip to have an undesirable "hammer head" or slightly wider shape than the remaining portions of the film strip.

It would therefore be desirable to provide a conformal coating applicator and method that prevent or at least reduce disruptions in the liquid flow upon opening the valve associated with the applicator.

SUMMARY

The present invention generally provides an applicator for dispensing a liquid conformal coating material onto a substrate. The applicator includes a body assembly with a liquid flow passage having a liquid inlet adapted to receive the coating material, and a liquid outlet. The body assembly includes a valve seat positioned between the liquid flow passage and the liquid outlet. A valve stem is mounted in the body assembly for reciprocating movement between an open position and a closed position. The valve stem includes a first end and a second end. The first end of the valve stem engages the valve seat in the closed position to stop flow of the liquid coating material through the outlet. The first end disengages from the valve seat in the open position to allow flow of the liquid coating material through the outlet. The body assembly further includes a valve actuating mechanism operative to move the valve stem from the open position to the closed position and further operates to move the valve stem from the closed position to the open position. A resilient dampening element is operatively coupled between the body assembly and the valve stem. The resilient dampening element provides a biasing force against the valve stem as the valve stem moves from the closed position to the open position. This eliminates, or at least reduces rebounding movement of the valve stem toward the closed position and results in a cleaner or sharper leading edge of the applied coating pattern.

Various other features and aspects may also be incorporated into the applicator. For example, in the preferred embodiment the resilient dampening element more specifically comprises a resilient, elastomeric material. The valve stem comprises an assembly including a piston. The piston is positioned in a piston chamber and the piston chamber is configured to receive pressurized air at least on one side of the piston for moving the piston and the valve stem to the open position. The valve actuating mechanism further comprises a spring return mechanism coupled to the valve stem and operative to move the valve stem from the open position to the closed position when the air pressure in the piston chamber is vented. The resilient dampening element is generally located between the valve stem and the hard stop element. A valve stroke adjuster includes a stroke adjustment element, such as a screw, that may be moved to adjust the distance that the valve stem travels between the open and closed positions. The resilient dampening element is located between the valve stem and the stroke adjustment element. In this embodiment, the stroke adjusting element is the hard stop. In one embodiment, the dampening element is in contact with the valve stem in the open and closed positions as well as during movement of the valve stem between the open and closed positions. As an alternative, there may also be a gap between the valve stem and dampening element when the valve stem is in the closed position.

The invention further provides a method of dispensing a liquid conformal coating. The method generally comprises supplying pressurized liquid conformal coating material to a liquid flow passage of an applicator. A valve stem is moved along a stroke length defined between a closed position in which the first end of the valve stem is engaged with a valve seat to prevent the flow of the liquid conformal coating material from the liquid flow passage to an outlet of the applicator, and an open position which the first end of the valve stem is disengaged from the valve seat to allow the liquid conformal coating material to flow from the liquid flow passage to an outlet of the applicator. A resilient, elastomeric element is compressed as the valve stem moves to the open position to provide a biasing force against the valve stem and eliminate, or at least reduce rebounding movement of the valve stem toward the closed position.

A preferred method further comprises compressing the resilient, elastomeric element between the stroke length adjustment element and the valve stem. The method further comprises moving the valve stem to the closed position with a spring return mechanism. The resilient, elastomeric element preferably contacts the valve stem in the open and closed positions as well as during movement of the valve stem along the stroke length between the open and closed positions. The method further comprises using a stroke length adjuster with an adjustment element contacting the resilient, elastomeric element and moving the stroke length adjustment element to vary the stroke length of the valve stem according to application needs.

Various additional features and aspects will become more readily apparent to those of ordinary skill in the art upon review of the following detailed description of an illustrative embodiment, taken in conjunction with the accompanying drawings.

DETAILED DESCRIPTION

Figure 1:
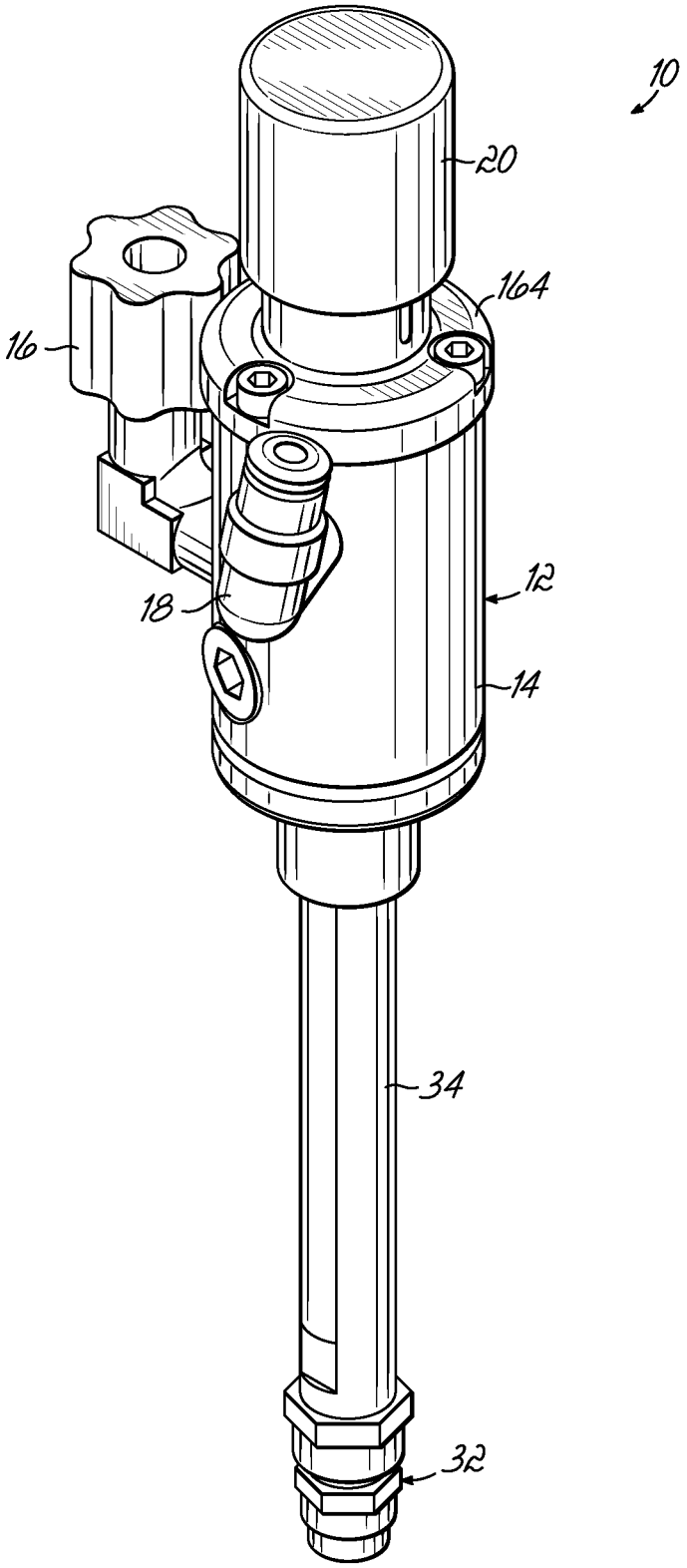
FIG. 1 is a perspective view of an applicator constructed in accordance with an illustrative embodiment of the invention.

Referring generally to FIG. 1, an applicator 10 is shown for applying conformal coating materials to substrates, such as electronic circuit boards, for purposes and in manners generally as described hereinabove. The applicator 10 generally includes a body assembly 12 having a main body 14 and a liquid inlet fitting 16 communicating therewith. The main body 14 further communicates with an actuating air inlet fitting 18 and includes a removable upper cap 20 that covers a stroke length adjustment mechanism 30 (see FIGS. 2 and 3). At an opposite end of the applicator 10, a liquid dispensing nozzle assembly 32 is coupled to an elongated extension 34. Except for the dampening feature that will be described in greater detail below, the remaining portions of the applicator may be constructed in accordance with existing conformal coating applicators, such as Model Nos. SC-104 or SC-204 manufactured by Nordson Asymtek of Carlsbad, Calif. For a complete understanding of principles connected with the present invention, a general description of the construction and operational details is given herein. It will be appreciated that the conformal coating applicator which incorporates the aspects of the present invention may be constructed in many various manners, with the embodiment disclosed herein being merely illustrative in nature.

Figure 2:
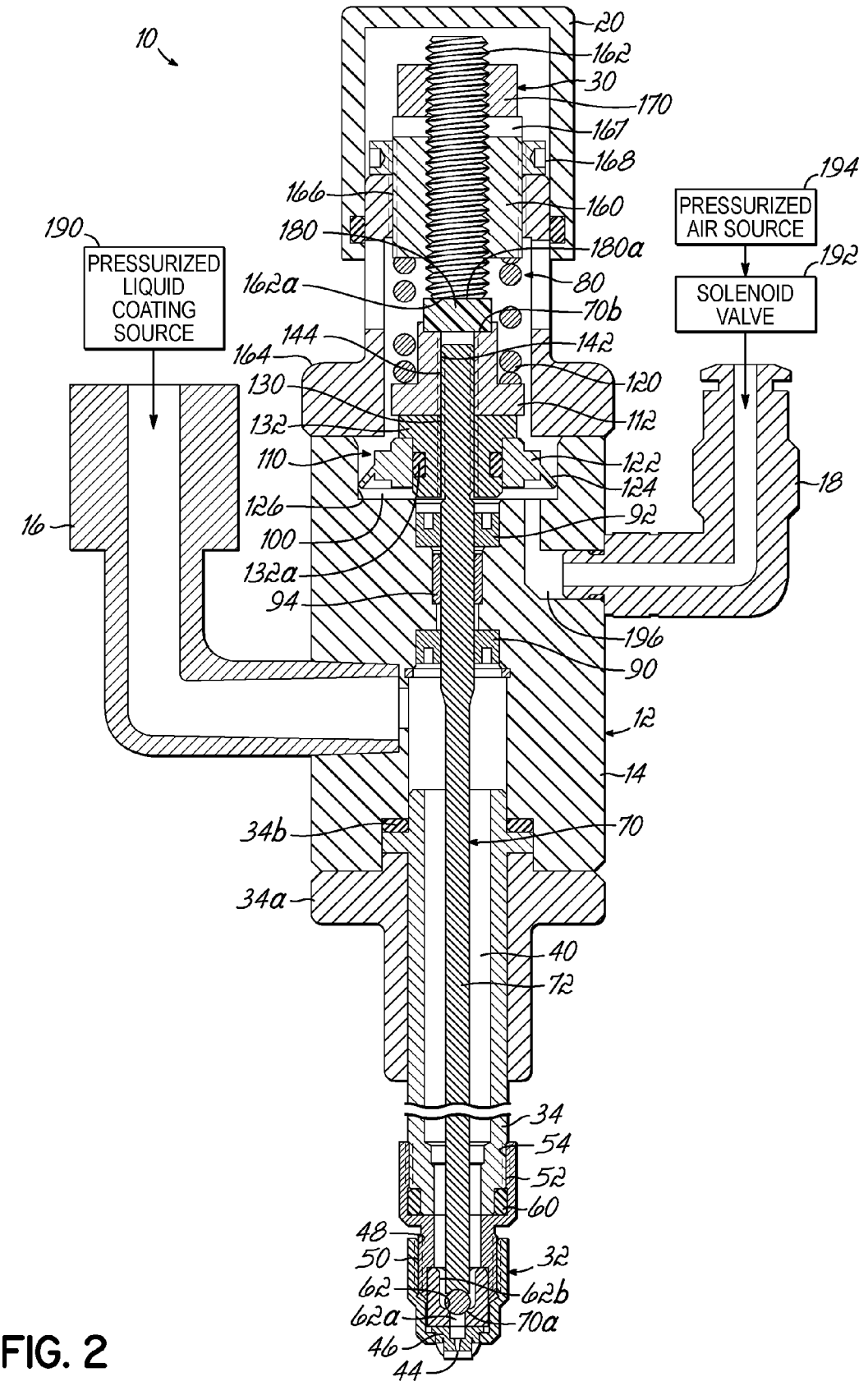
FIG. 2 is a longitudinal cross sectional view generally taken along the central axis of the applicator shown in FIG. 1, and showing a valve stem associated with the applicator in the closed position.
Figure 3:
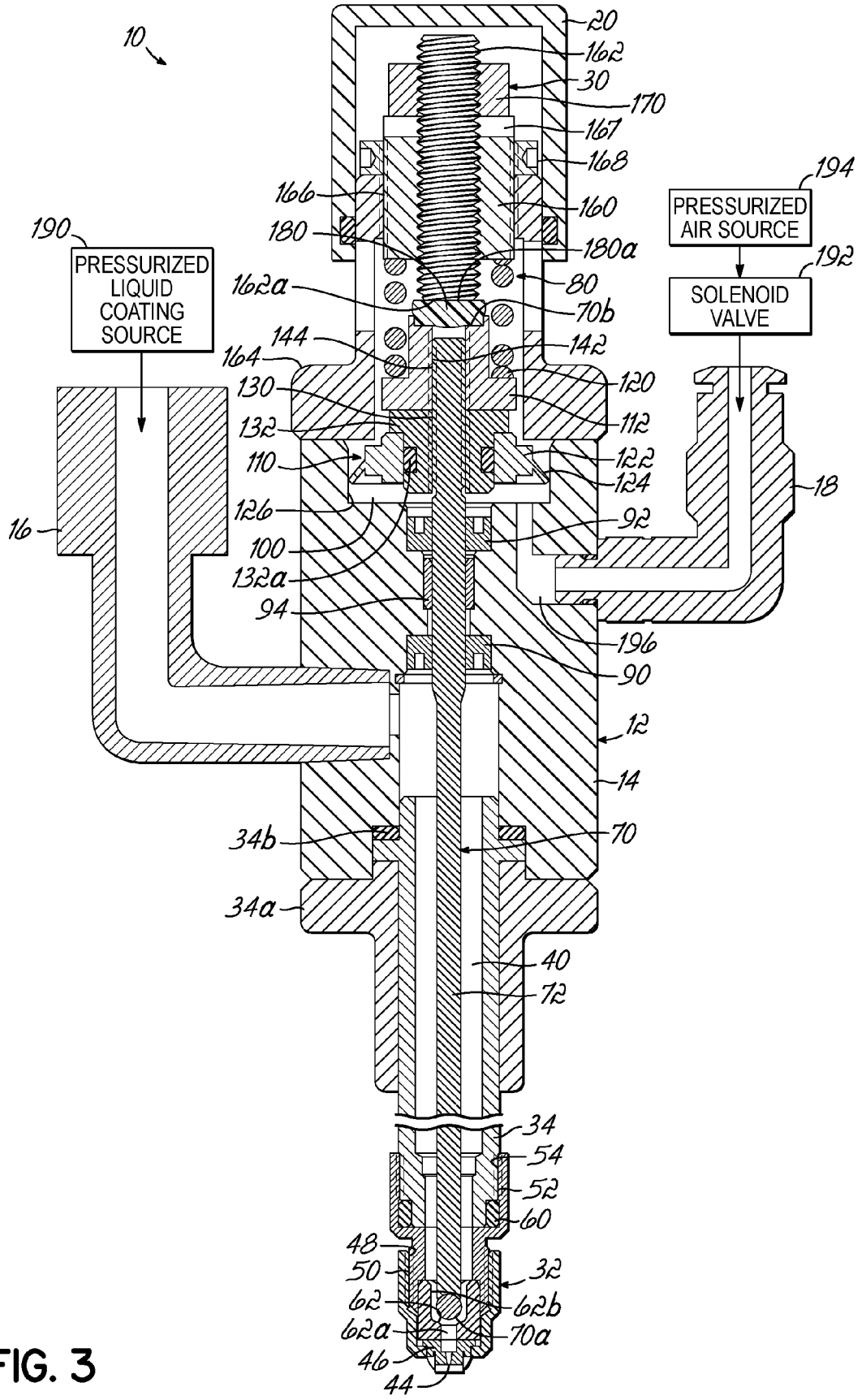
FIG. 3 is a cross sectional view similar to FIG. 2, but illustrating the valve stem in the open position.

Referring more specifically to FIGS. 2 and 3, the main body 14 and the extension 34 of the body assembly 12 generally further define a liquid flow passage 40. Extension 34 is secured to main body 14 by an extension retainer 34*a* which is attached by bolts (not shown) or other means to main body 14 to compress a gasket 34*b* between body 14 and a flange of extension 34. The liquid flow passage 40 communicates between the liquid inlet fitting 16 and a liquid outlet 44 of a nozzle element 46 configured to discharge a thin fan shaped film of liquid coating material. The nozzle element 46 may be removed and replaced with a nozzle that dispenses the liquid in a different pattern. For this purpose, the nozzle assembly 32 includes internal threads 48 that mate with external threads 50. The nozzle assembly 32 is coupled to the extension 34 by respective threads 52, 54. A seal is maintained by, for example, an O-ring 60.

The nozzle assembly 32 includes a valve seat 62 with a passage 62*a* communicating between the liquid flow passage 40 and the outlet 44 of the nozzle element 46. This passage 62*a* is selectively opened and closed by disengagement and engagement of the valve seat 62 with the first end 70*a* of a valve stem 70. The valve stem 70, in this embodiment, comprises an assembly including a needle 72 mounted for reciprocating movement within the liquid flow passage 40. The valve stem 70 also includes other components, as will be discussed below, and may take on other forms including assemblies or integrally formed stems. The first end 70*a* of the valve stem 70 is engaged with the valve seat 62 to close the passage 40 as shown in FIG. 2, but may be reciprocated or moved in an opposite direction to disengage the first end 70*a* of the valve stem 70 from the valve seat 62 as shown in FIG. 3. The valve stem 70 is mounted for movement generally between the valve seat 62 and a spring return mechanism 80. Spring return mechanism 80 forms part of the valve actuating mechanism which, in this embodiment, is an "air open, spring return" type mechanism as will be further discussed below. Other types of valve actuating mechanisms include fully pneumatic types, i.e., "air open, air closed" actuators and electric actuators. A pair of dynamic seals 90, 92 and a valve stem guide 94 are provided in the main body 14. The first dynamic seal 90 prevents liquid in the liquid flow passage 40 from leaking or migrating into a piston chamber 100 at the top of the main body 14. The second dynamic seal 92 prevents air in the piston chamber 100 from leaking or migrating into the liquid flow passage 40. The valve stem 70 is also preferably stabilized and guided at its lower or first end 70*a* by way of lateral engagement of the first end 70*a* of the valve stem 70 with internal walls 62*b* or surfaces of the valve seat 62.

The assembly that comprises valve stem 70 further includes a piston 110 as well as a receiving element 112 for a compression coil spring 120 associated with the spring return mechanism 80 and stroke adjustment mechanism 30. The piston 110 includes a piston element 122 having a surrounding wiper 124 that engages the internal walls 126 of the piston chamber 100. Piston element 122 is frictionally secured to an intermediate mounting element 132 in part by an O-ring 132*a*. Mounting element 132 is rigidly coupled to the needle 72 by way of a threaded connection 130 such that the piston element 122 moves with the needle 72 during reciprocating movement along the stroke length of the valve stem 70. The spring receiving element 112 is rigidly coupled for movement with the needle 72 by way of internal threads 142 engaging with the external threads 144 at the upper end of the needle 72. The compression coil spring 120 of the spring return mechanism 80 is positioned between the receiving element 112 and a spring preload element 160 that receives a threaded adjustment screw 162. The screw 162 serves as an adjustment stop element to limit upward movement of the valve stem 70, i.e., to set the "open" position of the valve stem 70. The preload element 160 is threadably received within an upper cap portion 164 of the body assembly 12 via a threaded connection 166. Upper cap portion 164 is attached to main body 14 by bolts (not shown) or other means. Using a tool (not shown)

placed in a slot 167, the preload element 160 may be rotated into upper cap portion 164 and will compress the spring 120 with the necessary preload. When the preload element 160 is positioned as desired, an internally threaded retainer 168 is tightened down against the cap portion 164 to maintain the position of the preload element 160. Rotation of the screw 162 will adjust the stroke length of the valve stem 70 or, in other words, the distance that the valve stem 70 travels in moving between the closed position shown in FIG. 2 and the open position shown in FIG. 3. Once the screw 162 is positioned to set the desired stroke length, a nut 170 may be tightened against the preload element 160 to maintain the position of the screw 162 and, more specifically, the position of its lower end 162*a*.

Figure 2A:
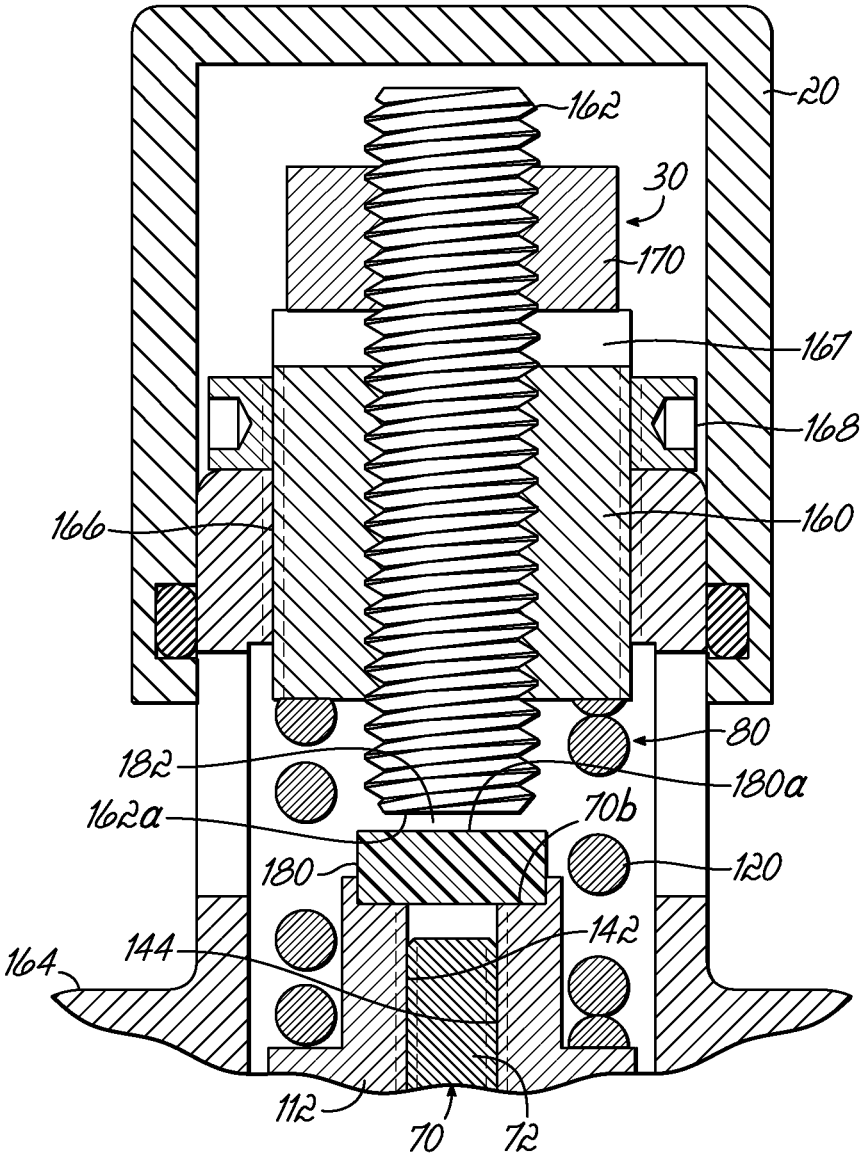
FIG. 2A is an enlarged cross sectional view showing an alternative embodiment.

A resilient dampening element 180, which may take the form of a disc-shaped elastomeric element or other suitable dampening element, is positioned between a portion of the body assembly 12 and the second end 70*b* of the valve stem 70. The body assembly 12 includes all structure of the applicator 10 except for the valve stem 70 and the resilient dampening element 180. The valve stem 70 includes all the elements that move with the valve stem 70 as it moves between its open and closed positions. In this embodiment, the resilient dampening element 180 is specifically located between the lower end surface 162*a* of the screw 162 of body assembly 12 and the spring receiving element 112 of the valve stem 70. The elastomeric element may be formed, for example, of natural or synthetic rubber materials, such as nitrile rubber, fluoroelastomers, or polyurethane, and may have a Durometer hardness in the range of 30-90. The preferred material is polyurethane. When the screw 162 is rotated, it moves along the long axis of the valve stem 70 to provide an adjustable stop position for the upper end 70*b* of the valve stem 70 which, in this case, is defined as the upper end of the spring receiving element 112 that forms part of the valve stem 70. Thus, if the screw 162 is backed off or rotated counterclockwise, when viewed from above in FIG. 2, the adjustment screw 162 will move away from the elastomeric element 180 and if it is rotated clockwise it will move toward the elastomeric element 180 to decrease the stroke length. Preferably, the applicator 10 is assembled such that the desired stroke length will be that associated with the position in which the threaded screw adjustment member 162 is just in contact with the upper surface of the elastomeric element 180, when the element 180 is not compressed. Thus, to decrease the stroke length, screw 162 may be moved toward the elastomeric element 180 by rotating the screw 162 clockwise and slightly compressing the elastomeric element 180. In a normal setup, however, the operator will adjust the screw 162 until the operator feels the adjustment screw 162 against the elastomeric element 180 at which point the operator will slightly back off or rotate the screw 162 in a counterclockwise direction, but not so much as to disengage the end 162*a* of the adjustment screw 162 from contact with the top 180*a* of the elastomeric element 180. This will maintain indirect contact or engagement between the adjustment screw element 162 and the upper or second end 70*b* of the valve stem (i.e., the upper end of the spring receiving element 112) when the valve stem 70 is in the closed position shown in FIG. 2, the open position shown in FIG. 3, and during the entire distance of travel between the open and closed positions. FIG. 2A shows an alternative embodiment in which there is a gap 182 between the top surface 180*a* of the elastomeric element 180 and the end 162*a* of the adjustment screw 162 when the valve stem 70 is in the closed position. The gap 182 is small enough that element 180 will still be compressed as the valve stem 70 opens, as discussed herein. Note that the elastomeric element 180 is compressed in exaggerated fashion in FIG. 3, which shows the open position of the valve, for illustrative purposes. Actual compression in this embodiment, when the valve is open, will be less. In this embodiment, the thickness of the elastomeric element 180 is 0.125 inch, and the stroke length is 0.015-0.030 inch. Since the upper end 70*b* of the valve stem 70 is contacting the elastomeric element 180 without noticeable compression when the valve stem 70 is in the closed position shown in FIG. 2, the amount of compression in the open position (FIG. 3) will be substantially equal to the stroke length.

In operation pressurized liquid conformal coating material is supplied from a suitable supply 190 through fitting 16 and into passage 40 with the valve stem in a closed position as shown in FIG. 2. Pressurized air is supplied to a solenoid valve 192 from a suitable source 194. When the solenoid valve 192 is opened, pressurized air will be directed through fitting 18 and into a passage 196 of main body 14 and into the piston chamber 100 on the lower side of piston element 122. This will force piston 122 upward, towards upper cap portion 164, carrying needle 72 along with the piston 122, and therefore valve stem end 70*a* will lift off of valve seat 62 allowing fluid to flow from the outlet 44 of nozzle element 46. As the valve stem 70 moves upward and reaches the fully open position shown in FIG. 3, it will be constantly compressing the elastomeric dampening element 180 positioned between the lower surface 162*a* of screw 162 and the spring receiving element 112. The resulting dampening effect will prevent or reduce a "rebounding" movement in the opposite direction and, therefore, liquid will flow from outlet 44 more uniformly. To close the valve, the pressurized air in piston chamber 100 may be vented from chamber 100 by conventional means (not shown) to allow the spring 120 to act on spring receiving element 112 to force piston intermediate mounting element 132 and piston 122 down and return the valve stem 70 to its closed position (FIG. 2). In addition to the force created by the spring 120, the compression of the elastomeric dampening element 180 will release and provide additional force to assist with closing the valve stem 70.

Figure 4:
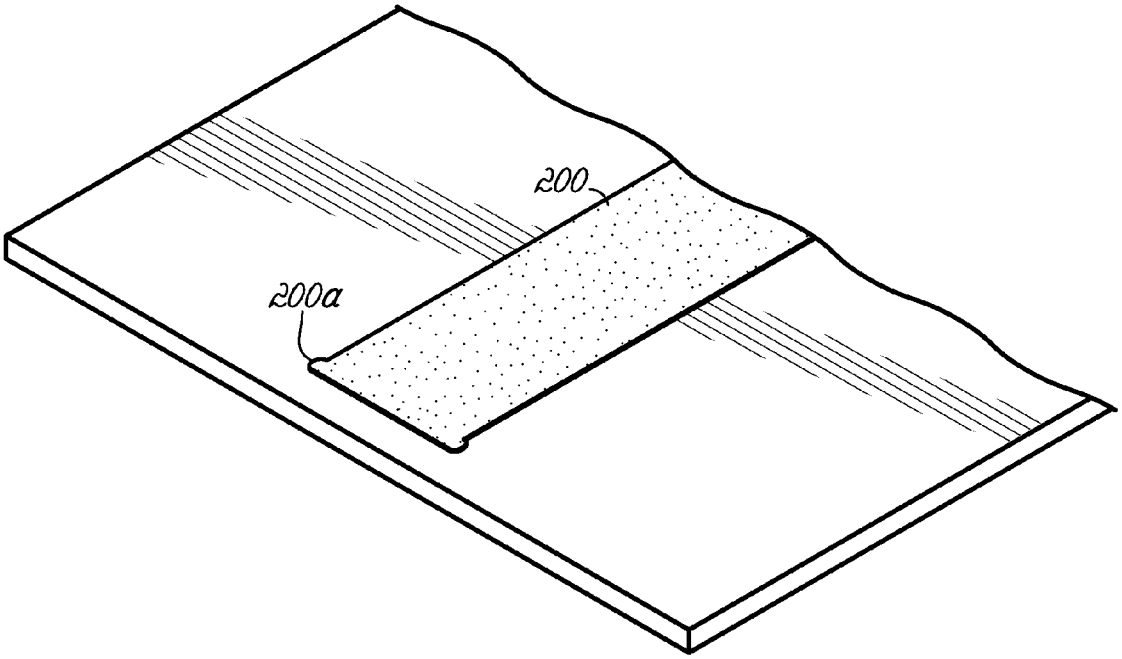
FIG. 4 is a schematic view of a representative conformal coating pattern dispensed in accordance with a conventional applicator.
Figure 5:
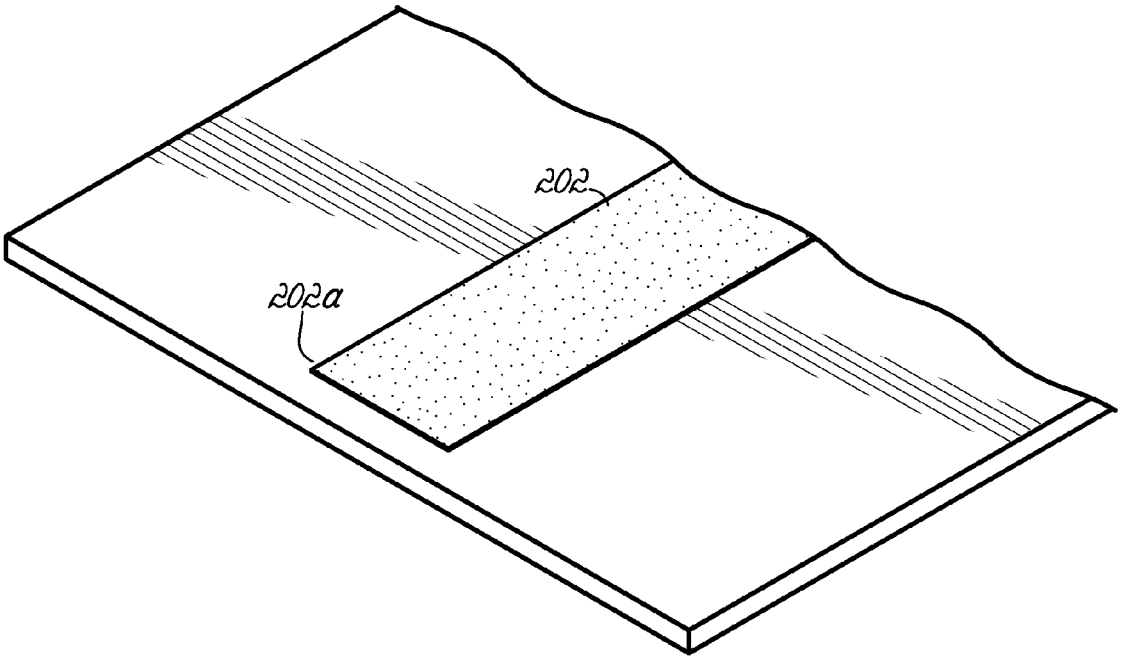
FIG. 5 is a schematic view of a conformal coating pattern dispensed with the applicator and in accordance with a method as described herein.

FIGS. 4 and 5 schematically illustrate, respectively, conformal coating films 200 and 202. Coating film 200 was applied by an applicator without the elastomeric element shown and described herein, while coating 202 was applied by the applicator 10 with the elastomeric element 180 as shown and described herein. With respect to the conventional film coating illustrated schematically in FIG. 4, the valve stem of the applicator abruptly impacted directly against the adjustment screw when it reached the fully open position. This caused a rebounding effect which then caused the "hammer head" to form at the front or leading edge 200*a* of the film coating 200. With the elastomeric element 180 in place as illustrated and described herein, the leading edge 202*a* of coating 202 (FIG. 5) does not have a pronounced "hammer head" disruption, but instead has a straighter or more perpendicular leading edge relative to the remainder of the film coating strip 202.

While the present invention has been illustrated by a description of various preferred embodiments and while these embodiments have been described in some detail, it is not the intention of the Applicants to restrict or in any way limit the scope of the appended claims to such detail. Additional advantages and modifications will readily appear to those skilled in the art. The various features of the invention may be used alone or in any combination depending on the needs and preferences of the user. This has been a description of the present invention, along with the preferred methods of practicing the present invention as currently known. However, the invention itself should only be defined by the appended claims.

What is claimed is:

1. An applicator for dispensing a liquid conformal coating material onto a substrate, the applicator comprising:

a body assembly including i. a liquid flow passage having a liquid inlet adapted to receive the coating material, and a liquid outlet;

ii. a valve seat positioned between the liquid flow passage and the liquid outlet; and iii. a valve actuating mechanism;

a valve stem mounted in the body assembly for reciprocating movement between an open position and a closed position, the valve stem including a first end and a second end, the first end of the valve stem engaging the valve seat in the closed position to stop flow of the liquid coating material through the outlet, and disengaging from the valve seat in the open position to allow flow of the liquid coating material through the outlet, wherein the valve actuating mechanism is operative to move the valve stem from the open position to the closed position and is further operative to move the valve stem from the closed position to the open position;

a valve stroke adjuster with a stop element for adjusting the distance that the valve stem travels between the open and closed positions; and a resilient dampening element located between the stop element and the valve stem, the resilient dampening element providing a biasing force against the valve stem as the valve stem moves from the closed position to the open position, wherein the resilient dampening element contacts the valve stem in the open and closed positions as well as during movement of the valve stem between the open and closed positions.

2. The applicator of claim 1, wherein the resilient dampening element further comprises an elastomeric material.

3. The applicator of claim 1, wherein the valve stem further comprises an assembly having a piston, the piston positioned in a piston chamber configured to receive pressurized air at least on one side of the piston for moving the piston and the valve stem to the open position.

4. The applicator of claim 3, wherein the valve actuating mechanism further comprises a spring return mechanism having a spring that exerts a spring force on the valve stem, the spring return mechanism being operative to move the valve stem from the open position to the closed position when pressurized air is vented from the piston chamber.

5. The applicator of claim 4, wherein the spring is a coil spring and the resilient dampening element is located within the coil spring.

6. The applicator of claim 1, wherein a gap exists between the resilient dampening element and the stop element when the valve stem is in the closed position.

7. An applicator for dispensing a liquid conformal coating material onto a substrate, the applicator comprising:

a body assembly including i. a liquid flow passage having a liquid inlet adapted to receive the coating material, and a liquid outlet;

ii. a valve seat positioned between the liquid flow passage and the liquid outlet;

iii. a valve actuating mechanism;

a valve stem mounted in the body assembly for reciprocating movement between an open position and a closed position, the valve stem including a first end and a second end, the first end of the valve stem engaging the valve seat in the closed position to stop flow of the liquid coating material through the outlet, and disengaging from the valve seat in the open position to allow flow of the liquid coating material through the outlet, wherein the valve actuating mechanism is operative to move the valve stem from the open position to the closed position and is further operative to move the valve stem from the closed position to the open position;

a valve stroke adjuster with a stop element for adjusting the distance that the valve stem travels between the open and closed positions; and a resilient dampening element formed from a resilient, elastomeric material and mounted at the second end of the valve stem, the resilient dampening element providing a biasing force against the valve stem as the valve stem moves from the closed position to the open position, wherein the resilient dampening element contacts the valve stem in the open and closed positions as well as during movement of the valve stem between the open and closed positions.

8. A method of dispensing a liquid conformal coating from an applicator having a valve stem, and providing sharper dispensed liquid patterns by reducing bounce back of the valve stem upon opening, comprising:

supplying pressurized liquid conformal coating material to a liquid flow passage of an applicator;

moving a valve stem along a stroke length defined between a closed position in which the valve stem is engaged with a valve seat to prevent the flow of the liquid conformal coating material from the liquid flow passage to an outlet of the applicator, and an open position defined by a valve stroke adjuster with a stop element wherein the valve stem is disengaged from the valve seat to allow the liquid conformal coating material to flow from the liquid flow passage to an outlet and produce a conformal coating pattern on a substrate; and compressing a resilient, elastomeric element between the valve stem and the stop element as the valve stem moves towards the open position; and maintaining contact between the resilient, elastomeric element and the valve stem in the open and closed positions as well as during movement of the valve stem along the stroke length between the open and closed positions.

9. The method of claim 8, further comprising:

moving the valve stem to the closed position with a spring return mechanism.

10. The method of claim 8, further comprising:

when the valve stem is in the closed position, forming a gap between the resilient, elastomeric element and the stop element.

* * * * *